US009993846B2

(12) United States Patent
Alsop, Sr.

(10) Patent No.: US 9,993,846 B2
(45) Date of Patent: Jun. 12, 2018

(54) SINGLE-STREAM SORTING SYSTEMS AND METHODS

(71) Applicant: Ultimate Specialties LLC, Denver, CO (US)

(72) Inventor: Danny E. Alsop, Sr., Arvada, CO (US)

(73) Assignee: Ultimate Specialties LLC, Denver, CO (US)

( * ) Notice: Subject to any disclaimer, the term of this patent is extended or adjusted under 35 U.S.C. 154(b) by 34 days.

(21) Appl. No.: 15/053,297

(22) Filed: Feb. 25, 2016

(65) Prior Publication Data

US 2016/0256898 A1 Sep. 8, 2016

Related U.S. Application Data

(60) Provisional application No. 62/127,017, filed on Mar. 2, 2015.

(51) Int. Cl.

| | |
|---|---|
| ***B07C 7/04*** | (2006.01) |
| ***B07B 13/00*** | (2006.01) |
| *B03B 9/06* | (2006.01) |

(52) U.S. Cl.

CPC ..... *B07C 7/04* (2013.01); *B07B 13/00* (2013.01); *B03B 9/06* (2013.01)

(58) Field of Classification Search

CPC ..... B07C 7/04; B07B 13/00; B07B 13/04; B07B 13/10; B03B 9/06; B03B 9/062; B65G 15/02; B65G 17/345; B65G 2201/02; B65G 2201/04

USPC ..... 209/616, 635, 692, 707, 930; 198/618, 198/793, 802, 804

See application file for complete search history.

(56) References Cited

U.S. PATENT DOCUMENTS 3,771,647 A * 11/1973 Cumpston, Jr. ..... B03B 9/06 209/639
3,948,386 A 4/1976 Nalbach
4,465,195 A 8/1984 Buer et al.
4,760,925 A 8/1988 Stehle et al.
(Continued)

OTHER PUBLICATIONS

International Search Report and Written Opinion for PCT/US2016/019750, dated May 5, 2016, 10 pages.
(Continued)

*Primary Examiner* — Joseph C Rodriguez
*Assistant Examiner* — Kalyanavenkateshware Kumar
(74) *Attorney, Agent, or Firm* — Kilpatrick Townsend & Stockton LLP

(57) ABSTRACT

Various arrangements involving a single-stream sorting system are presented, such as for use in sorting a single stream of recyclable materials. The single-stream sorting system may include a platform for an operator to stand on. The single-stream sorting system may include a circular conveyor that rotates in either a clockwise or counterclockwise direction to move the stream of items around the platform. The single-stream sorting system may include a plurality of item collector chutes arranged in a circular pattern around an outer circumference of the circular conveyor. The stream of items deposited on the conveyor is rotated around the circular platform and proximate to each item collector chute of the plurality of item collector chutes to allow items from the stream of items to be moved from the circular conveyor into the plurality of item collector chutes.

20 Claims, 11 Drawing Sheets

(56) References Cited

U.S. PATENT DOCUMENTS

| | | | | | |
|---|---|---|---|---|---|
| 4,763,793 | A * | 8/1988 | Stehle | B03B 9/06 | 209/696 |
| 5,060,782 | A * | 10/1991 | Marti | B65G 47/248 | 198/392 |
| 5,178,256 | A * | 1/1993 | Anderson | B65B 19/34 | 198/384 |
| 5,248,102 | A | 9/1993 | Bohn | | |
| 5,333,738 | A | 8/1994 | Fuchs et al. | | |
| 5,971,162 | A | 10/1999 | Allagant et al. | | |
| 6,651,802 | B2 * | 11/2003 | Hurst | B65G 47/846 | 193/12 |
| 8,430,228 | B2 * | 4/2013 | Herzog | B65G 47/1457 | 198/392 |

OTHER PUBLICATIONS

International Preliminary Report on Patentability for PCT/US2016/019750 dated Sep. 5, 2017, all pages.

* cited by examiner

SINGLE-STREAM SORTING SYSTEMS AND METHODS

CROSS-REFERENCE TO RELATED APPLICATION

This application claims the benefit of U.S. Provisional Patent Application No. 62/127,017, filed Mar. 2, 2015, entitled "A Compact and Labor-Efficient Single-Stream Sorting System," which is hereby incorporated by reference for all purposes.

BACKGROUND

In a typical single-stream recycling arrangement, consumers deposit all or some portion of their eligible recyclable items into a receptacle without performing sorting (hence the term "single-stream"). This results in paper, plastic, metal, and/or other types of recyclable materials being intermingled. At a recycling facility, the intermingled recyclable items are sorted from the single-stream into various categories, such as paper, plastic, aluminum, etc. While some of such sorting at a recycling facility can be automated, other tasks tend to remain at least partially manual, requiring some number of operators to perform. While having a large staff at a recycling facility may be cost effective for densely populated regions that have a high volume of recyclable items to sort, in smaller communities, such as rural areas, the volume of single-stream items that need to be sorted and bundled may be significantly lower.

SUMMARY

In various embodiments, a sorting system may be presented that include a platform; a conveyor that rotates to move items around the platform; and a plurality of item collector chutes arranged in a pattern around an inner and/or outer edge of a circular conveyor, wherein each item collector of the plurality of item collectors is designated for a particular type of item.

In various embodiments, a sorting system for sorting an unsorted stream of items may be presented. The system may include a frame structure. The system may include a platform attached with the frame structure. The system may include a circular conveyor that rotates in either a clockwise or counterclockwise direction to move the unsorted stream of items around the platform, the circular conveyor being attached with the frame structure. The system may include a plurality of item collector chutes arranged in a circular pattern around an outer circumference of the circular conveyor. Each of the plurality of item collector chutes may be attached with the frame structure. The unsorted stream of items deposited on the circular conveyor may be rotated around the platform and proximate to each item collector chute of the plurality of item collector chutes to allow items from the unsorted stream of items to be moved from the circular conveyor into the plurality of item collector chutes.

One or more of the following features may be present in various embodiments of a sorting system: The system may include a plurality of removable bins, wherein a removable bin of the plurality of removable bins is positioned below each item collector chute of the plurality of item collector chutes. The platform may be attached with the frame structure such that the platform is raised from ground on which the frame structure stands. The system may include a stream depositing conveyor that deposits the unsorted stream of items onto a starting position of the circular conveyor, wherein the circular conveyor rotates the unsorted stream of items from the starting position to being proximate to each item collector chute of the plurality of item collector chutes, and then to a final position. The system may include an ejection mechanism, the ejection mechanism being located at the final position to move any portion of the unsorted stream of items remaining on the circular conveyor at the final position into a residual item collector chute. The ejection mechanism may include a brush or blade that sweeps residual items from the stream of items present on the circular conveyor at the final position into the residual item collector chute. At least a portion of the stream depositing conveyor may be inclined. The platform may be circular and the platform has a radius of between 5 feet and 25 feet. The plurality of item collector chutes may include at least seven item collector chutes. The system may include an entrance system, wherein the entrance system is attached with the frame structure and allows a user access to the platform under the circular conveyor from the ground on which the frame structure stands.

In some embodiments, a method for sorting a stream of unsorted recyclable items may be present. The method may include depositing on a circular conveyor the stream of unsorted recyclable items. The method may include moving the stream of unsorted recyclable items on the circular conveyor in a clockwise or counterclockwise direction around a platform such that the stream is moved proximate to each item collector chute of a plurality of item collector chutes to allow items from the stream of unsorted recyclable items to be moved from the circular conveyor into the plurality of item collector chutes. The plurality of item collector chutes may be arranged in a circular pattern around an outer circumference of the circular conveyor.

Embodiments of such a method may include one or more of the following features: The method may include causing an item from the stream of unsorted recyclable items to be deposited into an item collector chute when the item is proximate to the item collector chute on the circular conveyor. The method may include transferring, using gravity or some other means of conveying, such as a conveyor or blower, the item from the item collector chute into an associated removable sorted item collector bin. Each item collector chute of the plurality of item collector chutes may be associated with a type of recyclable. Depositing of the stream of unsorted recyclable items onto the circular conveyor may be performed by an inclined stream depositing conveyor onto a starting position. Moving the stream of unsorted recyclable items on the circular conveyor may include rotating the stream around the platform from the starting position to being proximate to each item collector chute of the plurality of item collector chutes, and then to a final position. The method may include moving, by an ejection mechanism, residual items that were present in the stream of unsorted recyclable items into a residual item collector chute.

In some embodiments, a sorting apparatus is presented. The sorting apparatus may include a frame means (e.g., a metal structure or other structure made of a rigid material). The sorting apparatus may include a platform means (e.g., a metal, plastic, rubber, wooden, or other type of surface that is flat or nearly flat surface for one or more operators to stand or otherwise position themselves on) for one or more operators, the platform means being attached with the frame means. The sorting apparatus may include a conveyor means (e.g., a device that conveys, such as a circular rotating ring of material or an arrangement of conveyor belts) that rotates in either a clockwise or counterclockwise direction to move a stream of unsorted stream items around the platform means, the conveyor means being attached with the frame means. The sorting apparatus may include a plurality of item collection means (e.g., chutes made of metal, plastic, rubber, or another rigid or semi-rigid material) arranged in a circular pattern around an outer circumference of the conveyor means. The plurality of item collection means may be each attached with the frame means. The stream of unsorted stream items deposited on the conveyor means may be rotated around the platform means and proximate to each item collection means of the plurality of item collection means to allow items from the stream of unsorted stream items to be moved from the conveyor means into the plurality of item collection means.

Embodiments of such a sorting apparatus may include one or more of the following features: The sorting apparatus may include a depositing means (e.g., an intake conveyor or other device or system that can move a stream of items) that deposits the stream onto a starting position of the conveyor means, wherein the conveyor means rotates the stream from the starting position to being proximate to each item collector chute of the plurality of item collection means, and then to a final position. The sorting apparatus may include an ejection means (e.g., wiper blade, brush) that moves residual items from the stream present on the conveyor means at the final position into a residual item collection means.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1:
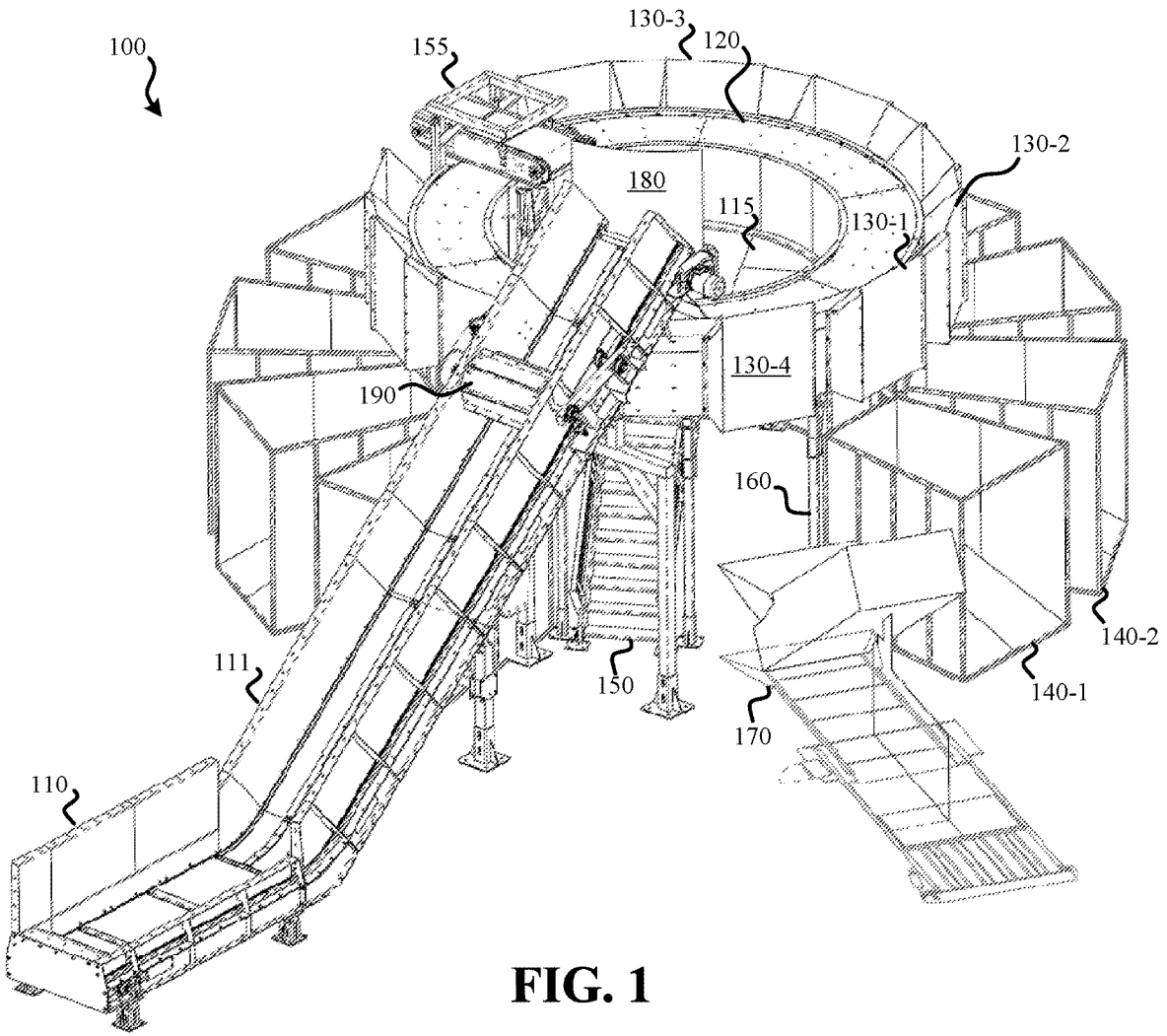
FIG. 1 illustrates an angled view of an embodiment of a single-stream sorting system.

While having a large staff at a recycling facility may be cost effective in densely populated regions that produce a large amount of recyclable material that needs sorting, in smaller communities the volume of single-stream items that need to be sorted and bundled may be significantly lower. Therefore, the number of persons that are practical to employ at a recycling facility servicing a smaller community may be significantly lower. For example, in a small community that sees a light volume of single-stream recycling, between one and nine people may be available at any given time to operate a sorting system.

Having such light staffing could be a significant impediment when using a conventionally designed single-stream sorting facility, which typically requires operators positioned at particular locations along linear intake conveyors to sort various types of items. In place of such a conventional single-stream sorting facility, a single-stream sorting facility as detailed below can allow for lighter staffing, possibly allowing the system to be operated by as few as a single operator.

Further, a smaller physical area may be available for installation of the single-stream sorting system. For instance, a maximum floor space of 5,000-6,000 sq. ft. may be available. Embodiments detailed herein may be installed in a location having such an available floor space. Similarly, a relatively low ceiling height may be present. Embodiments detailed herein, especially cellar entry designs, may accommodate such lower ceiling heights. Further, the embodiments detailed herein may allow for low electrical consumption and/or lower capital costs per sorted ton of recyclables as compared with conventional single-stream sorting systems.

In embodiments detailed herein, the single-stream sorting system has a central region that may be generally circular or oval in shape. Such a single-stream sorting system can be used for the sorting of recyclable materials, but such a system may have other possible applications such as for the sorting of other types of items (e.g., different types of hazardous materials, different colors of items). A first conveyor, which may be a conveyor belt, receives an unsorted single-stream of items. This single-stream of unsorted items typically includes a percentage of items that are eligible to be recycled and also some amount of items that the end consumer improperly considered recyclable. The first conveyor deposits the single-stream of unsorted items on a circular conveyor. This circular conveyor may be a continuous rotating ring that rotates in either a clockwise or counterclockwise direction around the central region, where one or more operators may be located.

In some embodiments, prior to the single-stream of unsorted items being deposited onto the circular conveyor, one or more sorting systems may remove particular types of items from the single-stream. For instance, a strong magnet may be arranged as part of the system somewhere along the unsorted stream of material (e.g., along the intake conveyor) and used to remove ferrous materials from the single-stream. Additionally or alternatively, a can sorter, such as an eddy current separator, can be used to remove aluminum cans from the single-stream of items. Additionally or alternatively, a cardboard sorting screen may be used to sort cardboard from the unsorted stream of items. In some embodiments, one or more of such automated sorting systems may be employed along the circular conveyor or to the remaining portions of the single stream of materials classified as residual after having been passed through the single-stream sorting system.

In the central region of the single-stream sorting system, which may be a raised platform, one or more operators may be present to perform sorting duties. Around the inside and/or outside edge of the circular conveyor, multiple item collector chutes may be present. In some embodiments, as detailed later in this document, one or more item collector chutes may be arranged around an inside edge of the circular conveyor. These item collector chutes may route items deposited into the item collector chutes to either removable bins, fixed bins, or directly to balers. In some embodiments, the platform is elevated such that sufficient room is present to allow the bins and/or the balers to be at least partially placed under the item collector chutes. When an operator deposits an item into an item collector chute, the item, assisted by gravity, is routed to the corresponding bin or baler. Each item collector chute is associated with a particular category of item. For instance, referring to recyclables, a first item collector chute may be designated for cardboard, a second item collector chute may be designated for a particular type of recyclable plastic, newspaper, etc.

As the first conveyor deposits the single-stream of items onto the circular conveyor, the circular conveyor rotates the single-stream of items around the platform near each item collector. The circular conveyor may position the stream of items such that it passes between an operator and an item collector chute. When an item is near the appropriate item collector chute, an operator present on the circular platform may move the item from the circular conveyor into the item collector. This may be accomplished by the operator simply pushing the item or by lifting and placing or tossing the item into the item collector. Depending on staffing levels, it may be appropriate to have an operator positioned on the platform opposite, across the circular conveyor from each particular item collector. When items that correspond to the item collector pass by on the circular conveyor, the operator may move the item from the circular conveyor to the item collector.

Due to the relative proximity of the item collector chutes, it may be practical for a single operator to sort items from the circulating single-stream of items into multiple item collector chutes. For instance, a particular operator may be responsible for sorting appropriate items from the circulating single-stream of items into two, three, or more item collectors bin. Since the platform is circular, a single operator may be able to easily and directly move to different positions on the platform located in the center of the circular conveyor to be able to sort items into multiple item collector chutes. The speed of the circular conveyor may be adjusted to accommodate the number of operators available to sort. That is, the larger the number of operators present on the circular platform performing sorting activities, the faster the circular conveyor may be rotated and/or the greater the volume of unsorted items may be deposited onto the circular conveyor. At a slow enough conveyor speed, it may be possible for a single operator to perform all of the sorting of the single-stream of items without needing to leave the circular platform.

Further, by allowing the stream of items to rotate around the circular conveyor more than once, a small number of operators (e.g., a single operator) may sort the entire stream. For instance, the operator may position himself in front of one or two chutes and only sort items that are part of the item types associated with such chutes. The operator may then reposition himself in front of another one or two chutes and sort items from the stream (which is now rotating for at least the second time in front of the user) into these chutes. The operator(s) may repeat this process as often as necessary to complete the sorting. Following all categories of items being sorted into appropriate chutes, an operator may engage an ejection device to clear the circular conveyor of all residual items that do not fall into a category eligible to be recycled. The process may then begin with a fresh portion of the unsorted stream of items being deposited onto the circular conveyor.

While embodiments detailed below focus on systems and methods for sorting an unsorted stream that includes recyclable materials, it should be understood that these systems and methods may be used for sorting other types of unsorted items. For example, an unsorted stream of types of textiles (e.g., cotton, polyester, etc.) may be sorted. As another example, the entire unsorted stream may be glass and sorting may be performed based upon color of the glass. In still another example, clothing may be sorted according to type (e.g., shirts, pants, jeans, shorts, socks, etc.)

FIG. 1 illustrates an embodiment of single-stream sorting system 100. Single-stream sorting system 100 can include: intake conveyor 110, vertical rise section 111, circular platform 115, circular conveyor 120, item collector chutes 130 (which include item collector chute 130-1, item collector chute 130-2, and item collector chute 130-3), sorted item collector bins 140 (which includes sorted item collector bin 140-1, sorted item collector bin 140-2, and sorted item collector bin 140-3), entry structure 150, metal sorter 155, frame 160, baler 170, deflector 180, and rate controller 190. It should be understood that in other embodiments certain components may not be present, such as baler 170, metal sorter 155, and/or deflector 180.

Intake conveyor 110 serves to deliver a single-stream of items that includes recyclable materials to circular conveyor 120. For instance, a single-stream of recyclable materials may be offloaded from a truck or other collection device onto intake conveyor 110. Intake conveyor 110 may deliver the recyclable items onto a receiving region of circular conveyor 120. Intake conveyor 110 may have a vertical rise section 111 (which can also be in the form of a series of two or more conveyors) configured to bring the single-stream of items up to a location where the single stream of items can be dropped or otherwise deposited onto circular conveyor 120. It may be necessary for intake conveyor 110 to have a vertical rise section 111 in order to accommodate circular platform 115 being raised from ground level. That is, if a portion of intake conveyor 110 runs parallel to ground level near or below the ground, vertical rise section 111 may move the single-stream of items to an appropriate elevation at which the stream can be dropped or otherwise deposited onto circular conveyor 120.

In some embodiments, one or more types of items are sorted out of the single stream of items while the stream is moved along intake conveyor 110 or on circular conveyor 120. For instance, a mechanical sorter may be positioned along intake conveyor 110 to remove specific materials from the single stream of items, such as glass or cardboard. As another example, an eddy current separator may be positioned along the circular conveyor near an ejection device to remove aluminum items (e.g., aluminum cans) from the single stream of items. In some embodiments, multiple sorting devices are positioned along sorting system. By removing such items mechanically the single stream being deposited onto circular conveyor 120, operators present on platform 115 may: 1) have to handle fewer items that need manual sorting; and/or 2) have easier access to items that do require sorting, since the stream of items has already been reduced in volume. In some embodiments, automated sorting equipment, such as an eddy current separator may be used to sort materials that were classified as residual. In such an embodiment, an operator may ignore aluminum cans when present on the circular conveyor because such cans will be separated from the stream later by the eddy current separator.

Present on intake conveyor 110 may be rate controller 190. Rate controller 190 may control the rate at which the single stream of items is deposited onto circular conveyor 120. Rate controller 190 may include a cylinder rotated above the linear conveyor of intake conveyor 110 that rotates against the flow of items. Items piled on intake conveyor 110 that exceed a certain height on intake conveyor 110 may be pushed back down conveyor 110 or otherwise held back from being deposited onto circular conveyor 120 until such items can fit under rate controller 190. Rate controller 190 may help ensure that a near constant flow of items, or at least a flow of items that does not exceed a maximum volume, is deposited onto circular conveyor 120.

When the single-stream of recyclable items is dropped or otherwise deposited onto circular conveyor 120 by intake conveyor 110, deflector 180 may help prevent deposited items from missing circular conveyor 120 and falling onto platform 115. Deflector 180 may be located along an inside edge of circular conveyor 120 such that items that impact deflector 180 are likely to fall down onto circular conveyor 120. Circular conveyor 120 may revolve such that the single-stream of recyclable items are passed around circular platform 115 in either a clockwise or counterclockwise manner. In the illustrated embodiment of FIG. 1, the single-stream of recyclable items is rotated in a counterclockwise direction. Circular conveyor 120 may have a solid surface made of a single piece of material or panels of material that rotate in a circle. It should be understood that various modifications may be made to cause circular conveyor 120 to be other than circular; for example, a series of linear conveyors may be arranged such that the overall shape of the path for the single stream of items over the series of linear conveyors is oval or rectangular.

Within the ring of circular conveyor 120 is circular platform 115. Circular platform 115 is where one or more operators are positioned in order to interact with the single-stream of recyclable items as it moves along the circular conveyor 120. Circular platform 115 may be at least roughly circular in shape and designed to be generally open in nature to allow an operator to move easily from side to side or otherwise from location to location along circular conveyor 120. For instance, it may be desirable for an operator to easily switch sides along a direct path across platform 115 without any or many obstacles. Further, an operator may frequently need to shift between being positioned in front of various item collector chutes 130. As an example, a single operator may be tasked with moving items that match particular item categories from the single stream of items on the circular conveyor into item collector chutes 130-1 and 130-2. In some embodiments, the platform may be other than circular.

Located around the outside edge of circular conveyor 120 are multiple item collector chutes 130. In the illustrated embodiment of FIG. 1, eleven item collectors are present (of which three are labelled). Each of these item collectors may be assigned to a particular type of recyclable item and may be labeled as such. For instance, a first item collector may be assigned fiber or paper, a second item collector may be assigned aluminum cans, a third item collector may be assigned certain types of recyclable plastic, etc. In some embodiments, the item collector chute which the single-stream of recyclable items will arrive at last, due to the clockwise or counterclockwise rotation of circular conveyor 120, may be a residual collector. Items that cannot be classified into any of the categories associated with the other item collector chutes may be dropped or deposited into this last item collector chute for delivery to a landfill or other non-recyclable disposal destination.

Item collector chutes 130 may serve to route items deposited into them into either an associated bin (e.g., sorted item collector bin 140-1, sorted item collector bin 140-2) or baler with the assistance of gravity or a conveying device, such as a conveyor or blower. Therefore, each item collector of item collector chutes 130 may consist of a partially or fully vertical chute to route deposited items to an associated bin or baler. Each item collector may include an open front portion located along an outer edge of circular conveyor 120, a backboard portion located away from the circular conveyor 120, and a vertical chute portion that routes deposited items to a bin or baler located generally below the item collector. Item collector chutes 130 may allow an operator to push an item off of circular conveyor 120 into an item collector chute selected by the operator as corresponding to the material type of the item. Such pushing may not require the item to be lifted. In other embodiments, the operator may need to lift the item, at least slightly, from the circular platform to throw or otherwise move the item into the corresponding item collector chute. In some embodiments, collector chutes may be located inside circular conveyor 120 such that an operator may pull or otherwise move the recyclable material inward from the circular conveyor 120.

Sorted item collector bins 140 generally refer to movable storage devices which temporarily store items. A bin may be removed from under its associated item collector chute either manually, such as by the bin being wheeled away, or using some form of machinery, such as a forklift. When full or otherwise desired to be emptied, a bin may be removed from under its item collector and taken to another location for removal of its contents, such as by depositing the bin's contents into a baler. Such bins may have an inside lower surface that is slanted, thus causing items to slide out of the bin when the bin is opened.

In some embodiments, one or more of the sorted item collector bins 140 may be fixed to the frame and are not easily removed. Such bins may be allowed to fill with sorted items. A panel of such a fixed bin may be opened to allow the sorted items to be removed. Alternatively, the fixed bin may be coupled with a conveying device, such as a conveyor or blower, such that items deposited into the fixed bin are moved by the conveying device to another location, such as to a baler.

In some embodiments, one or more of the sorted item collector bins 140 and one or more of item collector chutes 130 may be incorporated as a single device. That is, a bin may have an integrated chute. Such as bin may be removable. Thus, if the bin is removed, the chute may move with it. Further, such a bin having an integrated chute may be a fixed bin such that the combined chute and bin remain fixed to the frame.

In addition or alternatively to using a baler to bundle contents of sorted item collector bins 140, a baler or bundler may be placed directly under an item collector chute. A baler may serve to compact deposited items and bundle such items into roughly consistent sized or weighted bundles. For instance, once a sufficient number of aluminum cans are deposited into a baler, the baler may crush the cans and package them into a 1000 pound bundle. By placing baler roughly directly beneath item collectors, a step may be saved of having items placed in bins then having to be moved and transferred to a baler. In FIG. 1, baler 170 is located directly below item collector chute 130-4. Thus, when an operator moves an appropriate item into item collector chute 130-4, the item is routed to baler 170, which creates a bale using the deposited item.

An operator located on circular platform 115 may be able to simply push, pull, or throw an item off of circular conveyor 120 into an item collector, such as item collector chute 130-1, when the item arrives at least roughly in front of the item collector. Alternatively or additionally, the operator can lift and place or toss the item into the item collector. If the circular conveyor 120 is rotating slow enough and/or the volume of single-stream recyclable items being fed onto circular conveyor 120 is small enough, a single operator may be able to handle sorting recyclable items into multiple item collector chutes 130. For instance, an operator sorting recyclable items into item collector chute 130-1 may deposit all appropriate nearby items into item collector chute 130-1, then move to nearby item collector chute 130-2. The operator may then sort appropriate recyclable items into item collector chute 130-2. The operator may then move back to nearby item collector chute 130-1 into whose vicinity, by then, the circular conveyor 120 has moved new recyclable items of the single-stream into the vicinity. The operator may repeat moving between these two item collector chutes as long as necessary to sort recyclable items as circular conveyor 120 rotates. The speed at which circular conveyor 120 rotates may be adjusted by an operator. When slowed, the speed of intake conveyor 110 may also be slowed to decrease the volume of single-stream items being deposited onto circular conveyor 120. Generally, the speed of circular conveyor 120 and the volume of the single stream of items deposited onto the circular conveyor may be dependent on the number of operators present on platform 115 to perform the sorting. If the one or more operators cannot keep up with sorting of the stream, circular conveyor 120 and intake conveyor 110 may be slowed or even stopped to allow the one or more operators to catch up. In some embodiments, the stream of items continues to rotate around circular conveyor 120 for multiple revolutions, until the stream has been fully sorted or an operator engages an ejection mechanism to eject remaining residual items from the circular conveyor.

Entry structure 150 may permit operators entry and egress from circular platform 115. Entry structure 150 may include a series of stairs or ladder rungs that allow an operator to pass under circular conveyor 120 and enter onto elevated platform 115. In some embodiments, a panel may be slid, swung, or otherwise closed over the top of entry structure 150 to prevent operators from falling into entry structure 150 when they are standing on circular platform 420. Additionally or alternatively, handrails and toe rails may surround the top of entry structure 150 to prevent operators from falling into entry structure 150 when they are present on circular platform 420.

In other embodiments, an entry structure may include a staircase that ascends over circular conveyor 120 and then descends to platform 115 to allow for operators to enter and exit platform 115. If entry structure 150 passes over circular conveyor 120, sufficient clearance may be present between circular conveyor 120 and entry structure 150 to allow items to pass on circular conveyor 120 under entry structure 150. For an "over-the-top" entry structure design, since circular platform 115 may be raised to permit room for bins or bundlers underneath item collector chutes 130, the portion of entry structure 150 that descends to circular platform 115 may be shorter (e.g., have fewer stairs) than the portion of entry structure 150 that descends to the ground. In some embodiments, the entry structure 150 may be against or proximate to an ascending portion of intake conveyor 110. This may allow entry structure 150 to serve as an access device for user to be able to interact with various portions of the ascending portion of intake conveyor 110.

Platform 115, sorted item collector bins 140, item collector chute 130, circular conveyor 120, entry structure 150, deflector 180, and intake conveyor 110 may be mounted to frame 160. Frame 160 may serve as a support for platform 115 being raised from ground level. Frame 160 may be made from a strong, rigid material, such as steel, wood, or aluminum.

In addition to operators manually removing items from circular conveyor 120, one or more devices may be present that sort particular categories of items from the conveyor in an automated fashion. For example, metal sorter 155 may use a magnet to remove ferrous materials from circular conveyor 120 and deposit such items into a baler or bin (possible through an item collector chute). Metal sorter 155 may be located before, after, or among item collector chutes into which operators manually deposit items from the single stream of items being circulated by circular conveyor 120.

Figure 2A:
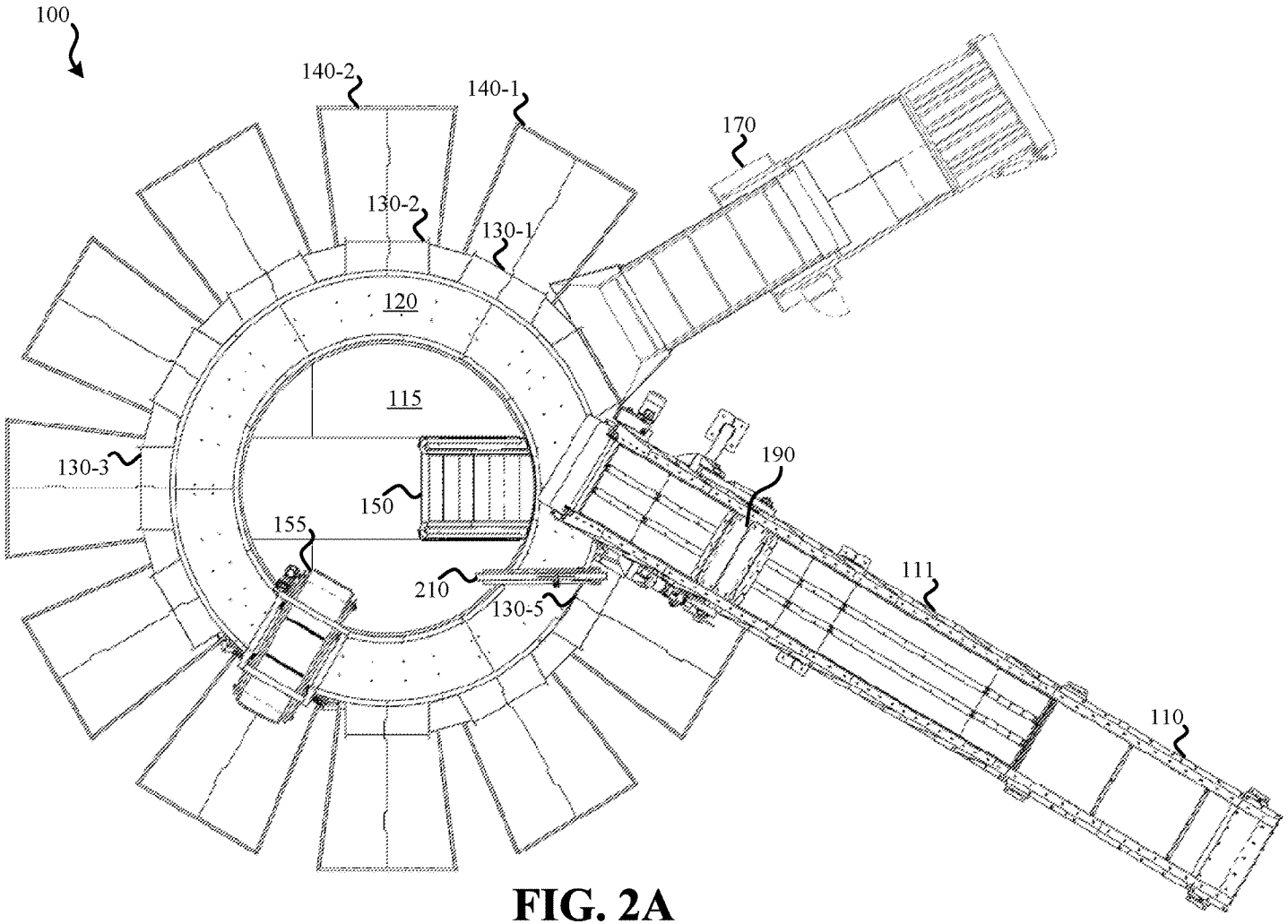
FIG. 2A illustrates a top view of an embodiment of a single-stream sorting system.

FIG. 2A illustrates a top view of an embodiment of single-stream sorting system 100. The embodiment of FIG. 2A represents a top view of single-stream sorting system 100 of FIG. 1. As can be seen in FIG. 2A, when an operator is located at or near a center of platform 115, the operator has a linear and equidistant path to each item collector chute. Thus, a single operator or a small number of operators (e.g., 2, 3, 4, 5) may efficiently operate single-stream sorting system 100 while located on circular platform 115.

Further, as can been seen in FIG. 2A, circular conveyor 120 is a ring having an inner edge located adjacent to platform 115 where the one or more operators stand (or sit) and where an outer edge is located adjacent to the openings of item collector chutes 130. Circular conveyor 120 may be made of a rigid or semi rigid material. Circular conveyor 120 may continually rotate (unless stopped by an operator) in a circle to move the single stream of items around platform 115, with all items from the single stream being deposited into one of the item collector chutes 130.

Items that have rotated past each of the item collector chutes 130 (save the last one), may be considered a residual item (that is likely not eligible to be recycled since it does not fall into any of the categories associated with the earlier item collector chutes and bins) and may be pushed or otherwise deposited into a final item collector chute 130-5 by ejection device 210. In some embodiments, ejection device 210 may be a brush and/or wiper blade that sweeps items on the surface of circular conveyor 120 into item collector chute 130-5. By ejection device 210 being at an angle to a radial path of circular conveyor 120, the rotation of circular conveyor 120 may cause items that contact ejection device 210 to enter item collector chute 130-5 and fall into the bin or baler located below. As such, ejection device 210 may be located in a fixed position above circular conveyor 120. In other embodiments, when an item is sensed against or near item ejection device 210, item ejection device 210 may actively sweep the item into item collector chute 130-5. In either of these embodiments, since the items are swept into item collector chute 130-5 by ejection device 210, the one or more operators may leave any residual item on circular conveyor 120 and allow ejection device 210 to remove the item from circular conveyor 120. Once ejection device 210 has removed any residual items from circular conveyor 120, circular conveyor 120 continues to rotate under ejection device 210 and receive a newly-deposited portion of the single stream of unsorted items from item conveyor 110.

In some embodiments, such a last bin may be used for items from the single-stream that have not yet been attended to by an operator. For instance, if circular conveyor 120 is moving at such a speed that the one or more operators present on circular platform 115 cannot sort all items from the single-stream, items that were unattended to may end up in such a residual bin. Contents of such a bin may be set again onto intake conveyor 110 to allow for the operators to have another chance to sort such items.

In some embodiments, ejection device 210 does not push items into a bin, but rather can be actuated by an item contacting it and thereby triggers circular conveyor 120 to stop (in such embodiments, ejection device 210 may be referred to as a stop trigger device). By stopping circular conveyor 120, the one or more operators present on circular platform 115 may have time to attend to items present on circular conveyor 120 and specifically attend to items that actuated ejection device 210. Therefore, such an ejection device 210 that can be actuated serves to pause circular conveyor 120 and the single-stream of items it is circulating when the attending operators fall behind. When circular conveyor 120 is paused, intake conveyor 110 may also be paused to prevent additional single-stream items from being deposited onto the paused (nonrotating) circular conveyor 120.

In some embodiments, ejection device 210 can be engaged or disengaged by an operator. When disengaged, items may continue to rotate around circular conveyor 120 an unlimited amount of times until an operator removes such items from circular conveyor 120. Such an arrangement may be useful if only a single operator, or a small number of operators, is available to sort items. When the operator is done sorting, such as when only residual items are left on circular conveyor 120, ejection device 210 may be engaged such that ejection device 210 pushes or sweeps the items remaining on rotating circular conveyor 120 into a residual chute and accompanying bin. When ejection device 210 is disengaged, while circular conveyor 120 may be rotated, intake conveyor 110 may be stopped an may not deposit an unsorted stream of items onto circular conveyor 120.

Further, as can been seen in FIG. 2A, circular platform 115 is kept open except for the portion occupied by entry structure 150. Having circular platform 115 open allows operators to easily move to among multiple item collector chutes 130. It should be understood that the number of item collector chutes 130 can be adjusted as necessary; in some embodiments, fewer item collectors are present, in other embodiments a greater number of item collectors (which correspond to more types of items being sorted) may be present.

Figure 2B:
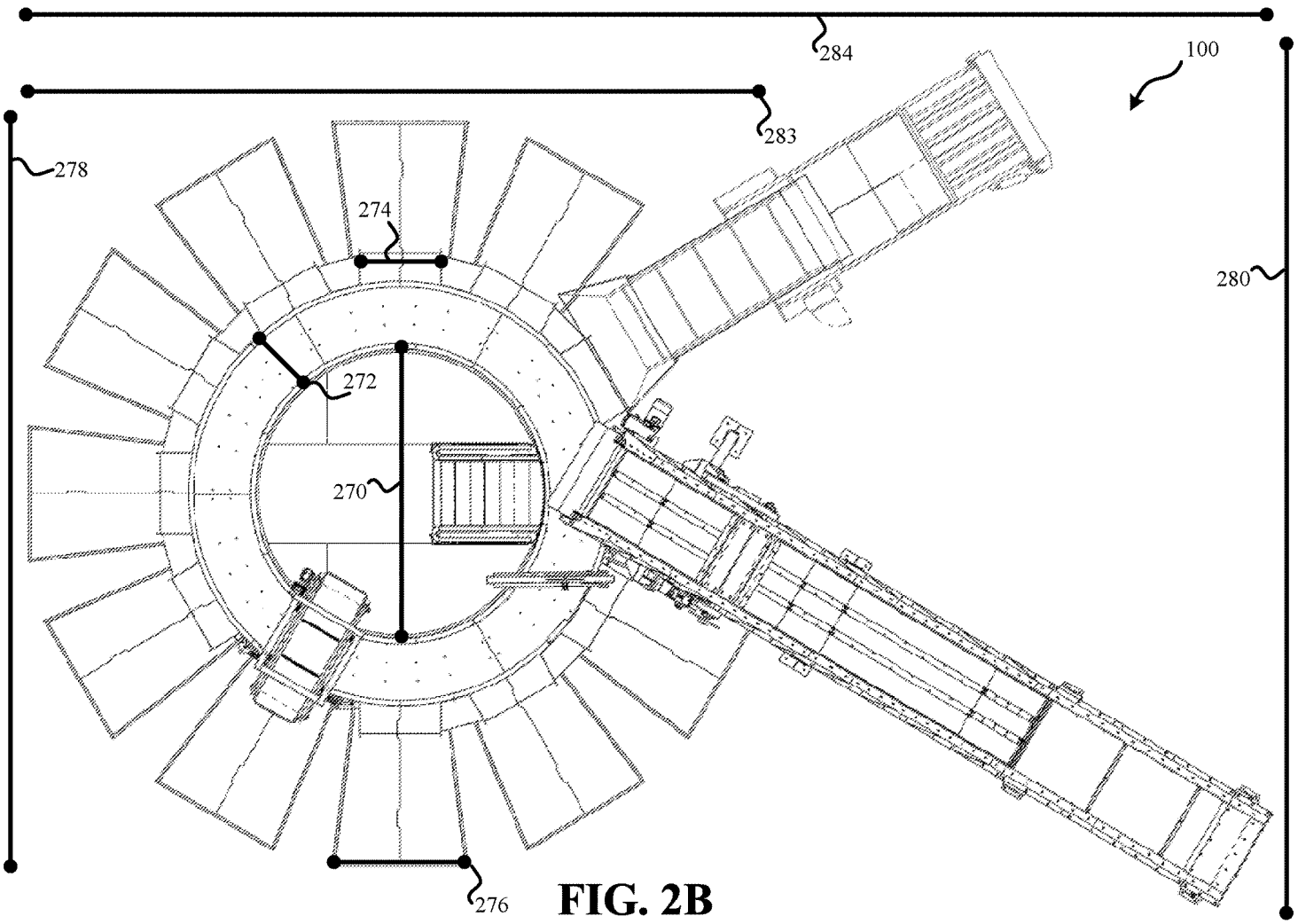
FIG. 2B illustrates a top view of an embodiment of a single-stream sorting system with dimensions.

FIG. 2B illustrates a top view of an embodiment of a single-stream sorting system with dimensions. Various dimensions are provided. For instance, dimension 284 of single-stream sorting system 100 may be 70 feet long or less (e.g., as short as 25 feet). Dimension 280 may be 36 feet wide or less (e.g., as short as 20 feet). Such dimensions may allow single-stream sorting system 100 to be fit in a relatively small warehouse or other area. It should be understood that the size of single-stream sorting system 100 may be adjusted up or down depending on the number of operators to be accommodated on circular platform 115 and/or the number of item collectors to be used.

In single-stream sorting system 100, intake conveyor 110 may be four feet wide. In other embodiments, intake conveyor 110 may vary to be greater or smaller in width (e.g., between 2 and 6 feet wide). In single-stream sorting system 100, dimension 270, which is the platform's diameter, could be 14 feet or greater. In other embodiments, the circular platform may be between 10 and 50 feet in diameter or have a still bigger or smaller diameter. In single-stream sorting system 100, circular conveyor 120 may have a width of 3 feet, indicated by dimension 272. An inner edge diameter of fourteen feet and an outer edge diameter of twenty feet may be present for circular conveyor 120. The inner edge of circular conveyor 120 may be roughly the same diameter as circular platform 115. In other embodiments, circular conveyor 120 may have an outer radius between 26 and 16 feet in diameter or have a still bigger or smaller diameter. The width of circular conveyor 120 may also be increased or decreased in other embodiments. Dimension 274, which represents an opening of an item collector chute, may be 3 feet in width (e.g., with an open top). Dimension 274 may be varied between 2 and 5 feet, or in some embodiments, may be even larger. Each item collector chute of item collector chutes 130 may be approximated a foot and a half in depth and three feet in width to accommodate items being deposited. The dimensions of item collector chutes 130 may be varied to be bigger or smaller. Further, it may be possible for item collectors for specific types of items to be varied from item collectors for other types of items. Therefore, the item collectors arranged around circular conveyor 120 may vary in size depending on the types of items which need to be accommodated. Dimension 276, which represents the maximum width of a removable bin, may be about 5 feet. Dimension 276 may be varied to be larger or smaller. Dimensions 278 and 283 may be about 36 feet. Dimensions 278 and 283 may range from about 15 feet to about 50 feet, depending on the embodiment.

Figure 2C:
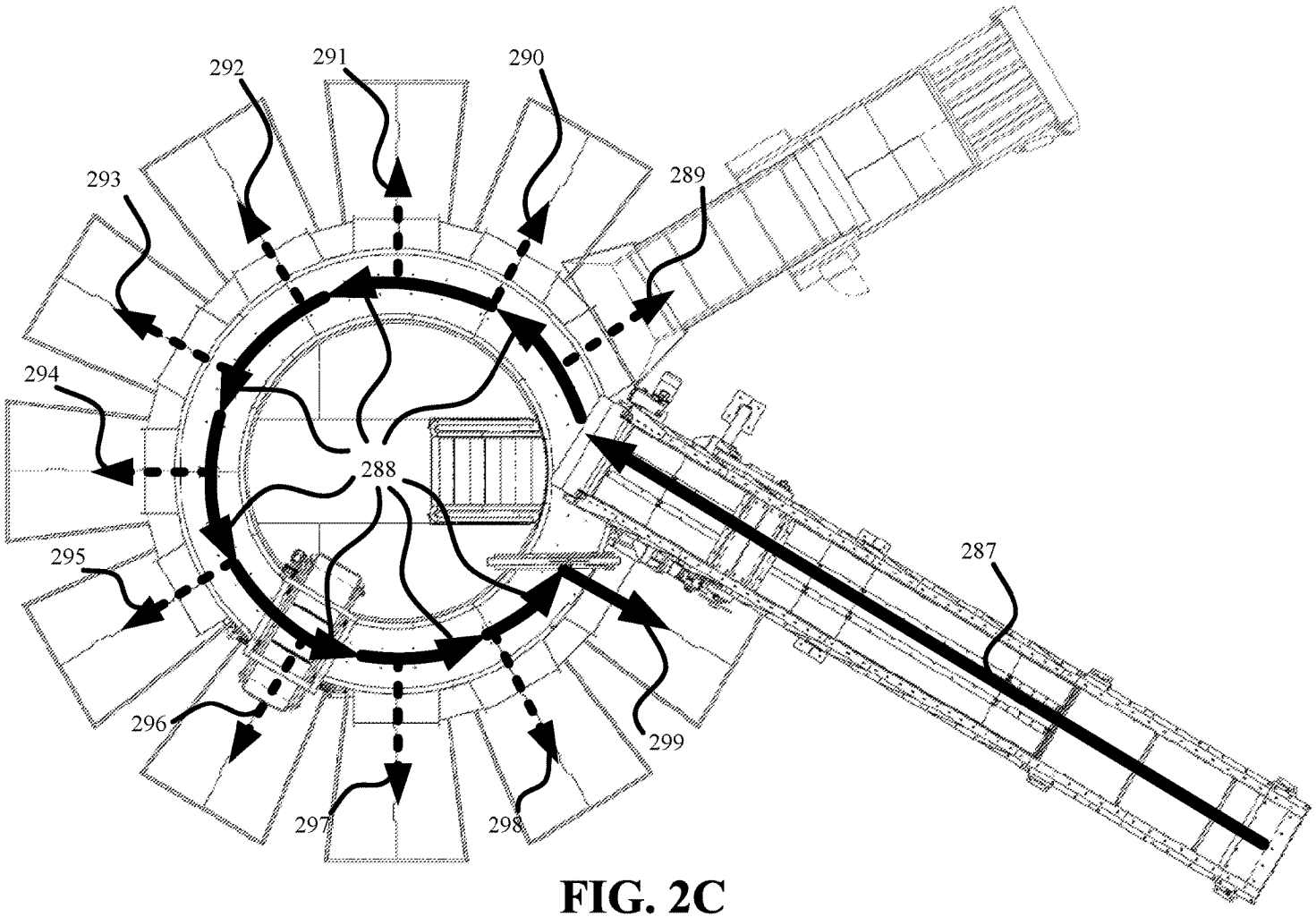
FIG. 2C illustrates a top view of an embodiment of a single-stream sorting system with an overlay of arrows showing the possible paths of items of the single-stream.

In FIG. 2C a graphical representation of the distribution of items (as performed by system 100 in combination with one or more operators) is presented using arrows. Single-stream sorting system 100 first brings items onto circular conveyor 120 via a conveyor that follows arrow 287. Arrows 288 illustrate the path that the single stream of items is rotated around the platform. An operator may push or otherwise move an item from the rotating single stream of items into a corresponding item chute along one of the paths illustrated by arrows 289, 290, 291, 292, 293, 294, 295, 296, 297, or 298. An ejection mechanism may push or otherwise move any portion of the single-stream remaining—after the single stream has been rotated past every other item collector chute—according to arrow 299 into a final item collector chute that is associated with residual items. Items may remain on the circular conveyor for a second rotation around the platform at the discretion of an operator. The cleared circular conveyor may be filled with another portion of the single-stream of items to be sorted.

Figure 2D:
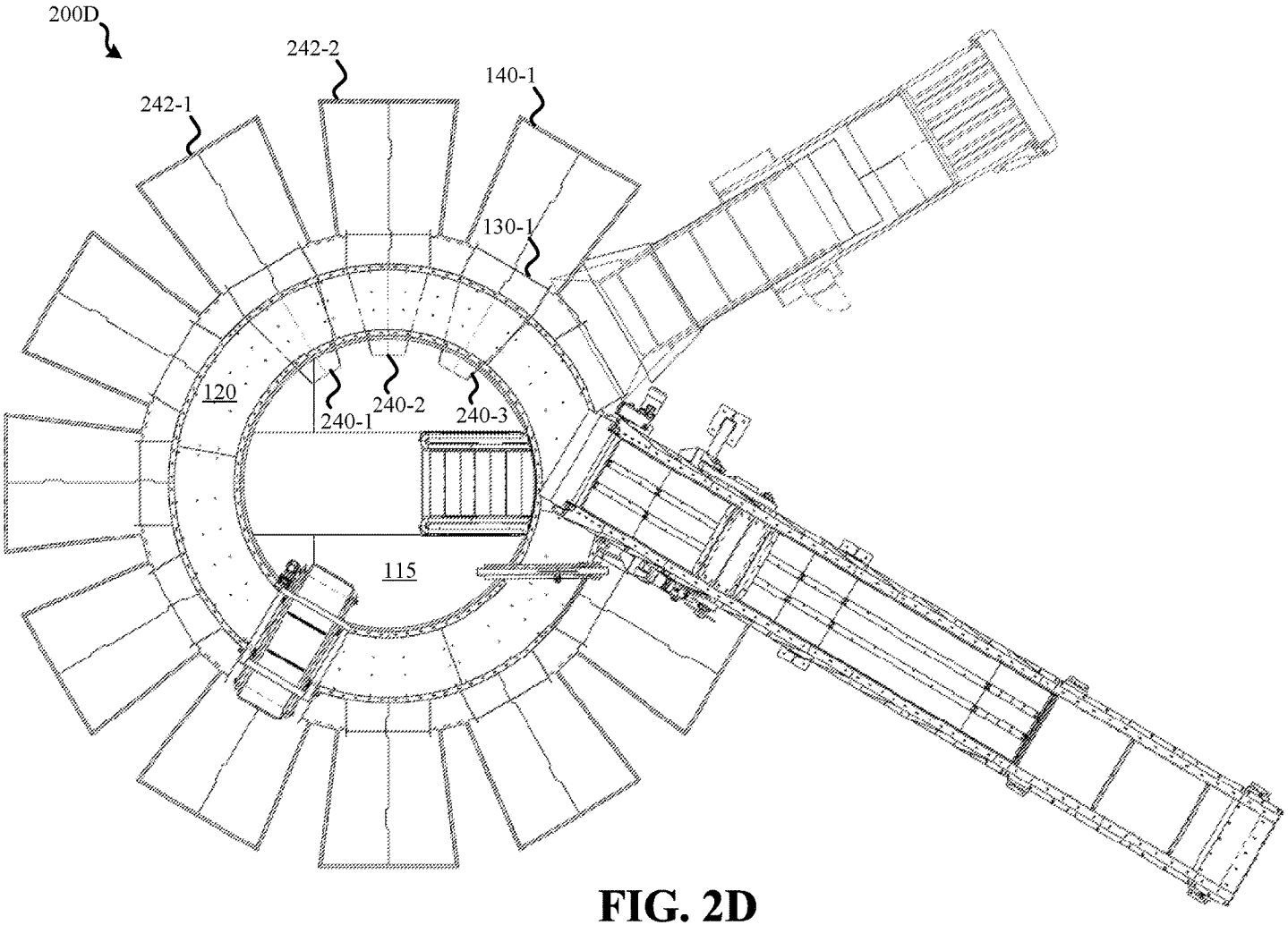
FIG. 2D illustrates a top view of another embodiment of a single-stream sorting system that uses alternate arrangements of item collector chutes.

FIG. 2D illustrates a top view of another embodiment of a single-stream sorting system 200D that uses an alternate arrangement of item collector chutes. In single-stream sorting system 200D, item collector chutes are positioned under and/or along or within an inner edge of circular conveyor 120. Inner item collector chutes 240 (which can include inner item collector chutes 240-1, 240-2, and 240-3) may allow an operator to pull, drag, or otherwise move an item from circular conveyor 120 toward the operator and drop or otherwise place the item into the item collector chute located between circular conveyor 120 and the operator on platform 115. Such inner item collector chutes 240 may, in some embodiments, be fully or partially located underneath circular conveyor 120 and raised a distance from platform 115. Inner item collector chutes 240 may alternatively be level or roughly level with an inner edge of circular conveyor 120. Inner item collector chutes 240 may similarly direct deposited items to item collector bins. An opening for an inner item collector chute may be smaller than an item collector chute of item collector chutes 130.

For an item collector bin, such as sorted item collector bin 140-1, either or both of item collector chute 130-1 and 240-3 may be present. If both are present, the operator may push or pull the item to be deposited—whichever is easier—into either item collector chute 130-1 or inner item collector chute 240-3, respectively. The item will then be routed to same item collector bin 130-1 regardless of which item collector chute is used. If only an inner item collector chute is present, such as for inner item collector chute 240-2, the operator may need to pull the item to be deposited towards himself. In some embodiments, an inner item collector chute 240 may direct items to a different item collector bin than an outer collection bin. For instance, in some embodiments, item collector chute 130-1 may direct items to sorted item collector bin 140-1, while inner item collector chute 240-3 directs items to another item collector bin (not pictured), such as an item collector bin located beneath platform 115. Thus, when such inner collector chutes are used that route to different item collector bins, by an operator standing in a single position, the number of items that the operator can effectively sort is increased.

It should be understood that the embodiment of FIG. 2D is merely exemplary. Embodiments of single-stream sorting system 200D may be created that include various numbers of inner item collector chutes 240 and item collector chutes 130 as needed to suit the particular purpose of the single-stream sorting system.

Figure 3:
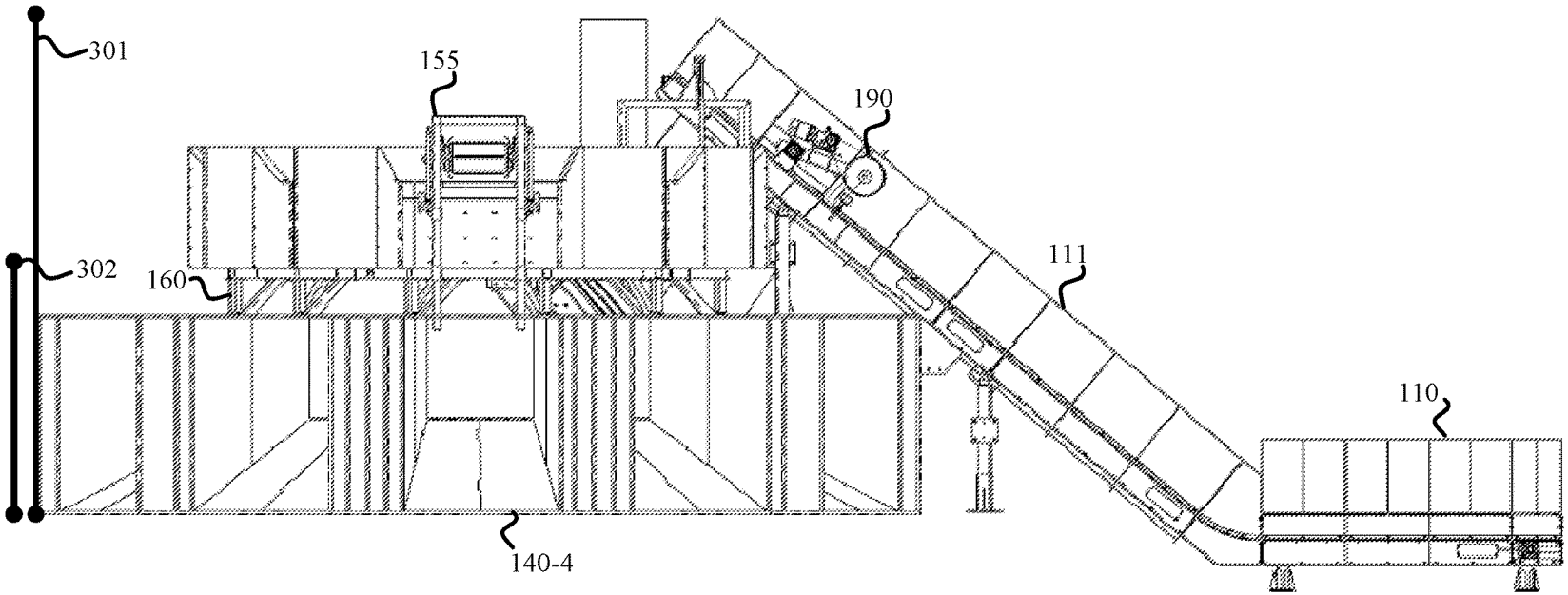
FIG. 3 illustrates a side view of an embodiment of a single-stream sorting system.

FIG. 3 illustrates a side view of an embodiment of single-stream sorting system 100. As represented in FIG. 3 by dimension 301, the total height of single-stream sorting system 100 may be seventeen feet or less (e.g., as short as 6 feet). Some common embodiments may be between 12 and 25 feet. Dimension 302 may be 9 feet, which represents a distance that circular platform 115 may be elevated above the ground to permit bins and/or balers to be placed at least partially beneath item collector chutes 130. In other embodiments, circular platform 115 may be between 4 and 15 feet off the ground or floor. Similarly bins and/or balers that are at least slightly below circular platform 115 in height may be used, such as seven or eight feet in height. Such a height may be adjusted in accordance with the height of circular platform 115. In some embodiments, sorted item collector bins 140 may be located beneath a false floor or on a lower level, thus enabling platform 115 to be located at ground level and, possibly, not requiring an entry structure in order for an operator to arrive and exit the platform.

Figure 4:
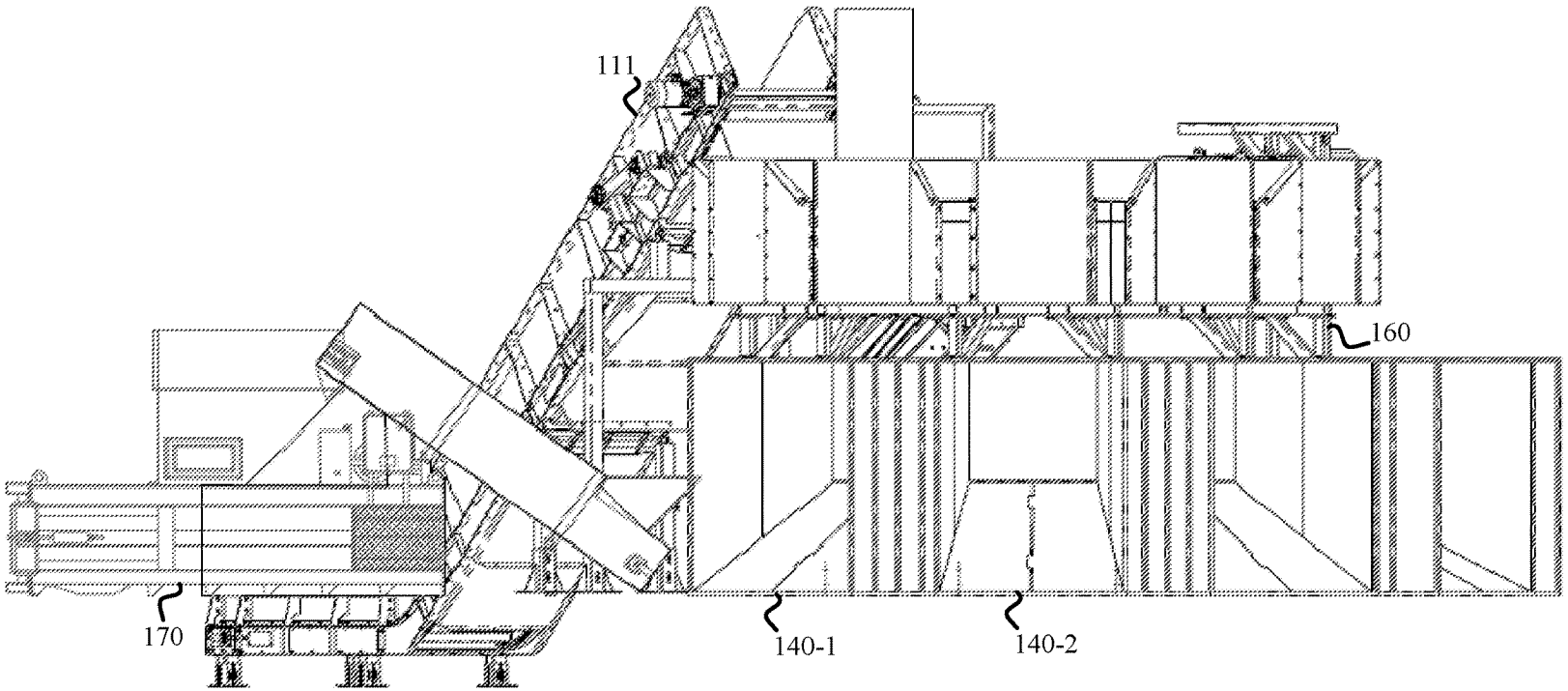
FIG. 4 illustrates another side view of an embodiment of a single-stream sorting system.
Figure 5:
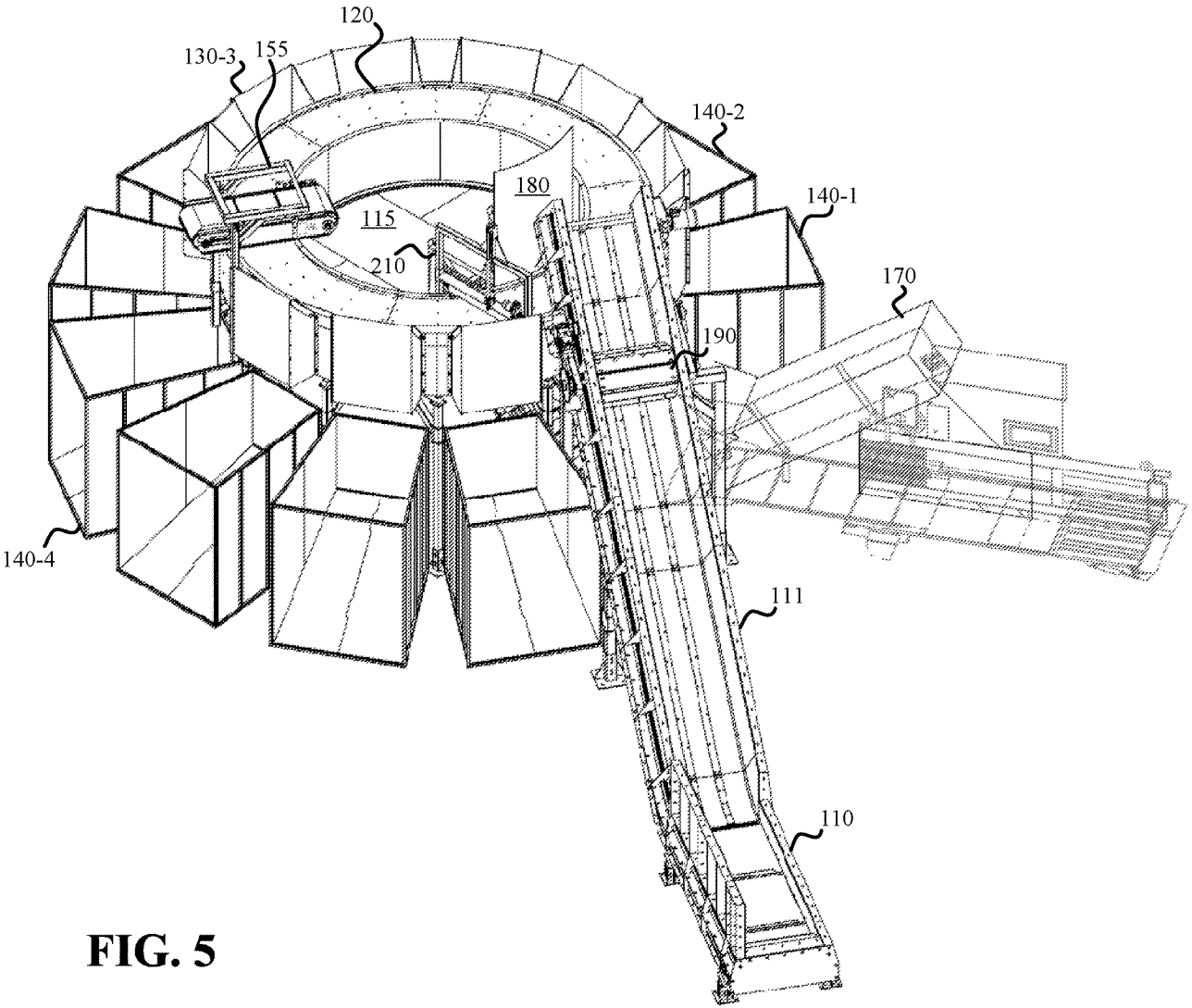
FIG. 5 illustrates another angled view of an embodiment of a single-stream sorting system.

FIG. 4 illustrates another side view of an embodiment of a single-stream sorting system 100. In FIG. 4, details of baler 170 may be seen, along with portions of frame 160. As can be seen in FIG. 4, a distance may be present between a bottom of item collector chutes 130 and the associated sorted item collector bins. In this distance, items deposited into an item collector chute may free fall into the item collector bin located below. FIG. 5 illustrates another angled view of an embodiment of a single-stream sorting system 100.

Figure 6:
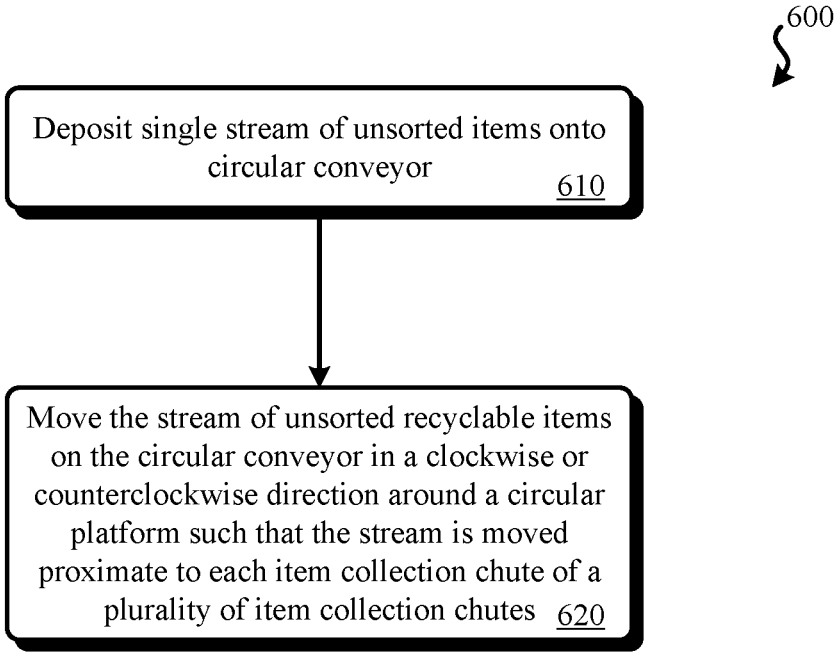
FIG. 6 illustrates an embodiment of a method for using a single-stream sorting system.

Various methods may be performed using the various embodiments of single-stream sorting systems discussed in relation to FIGS. 1-5. FIG. 6 illustrates an embodiment of a method 600 for using a single-stream sorting system. At block 610, a single stream of unsorted items is deposited onto a circular conveyor. At block 620, the single stream of unsorted items is rotated around a platform in either a clockwise or counterclockwise direction. The rotation of the single stream of unsorted items passes the single stream in front of an opening for multiple item collector chutes. An operator can, while an item is generally proximate to an item collector chute assigned to the type of item, push or otherwise move the item into the associated item collector chute. This process may continue indefinitely to allow a continuous stream of items containing recyclable materials to be sorted.

Figure 7:
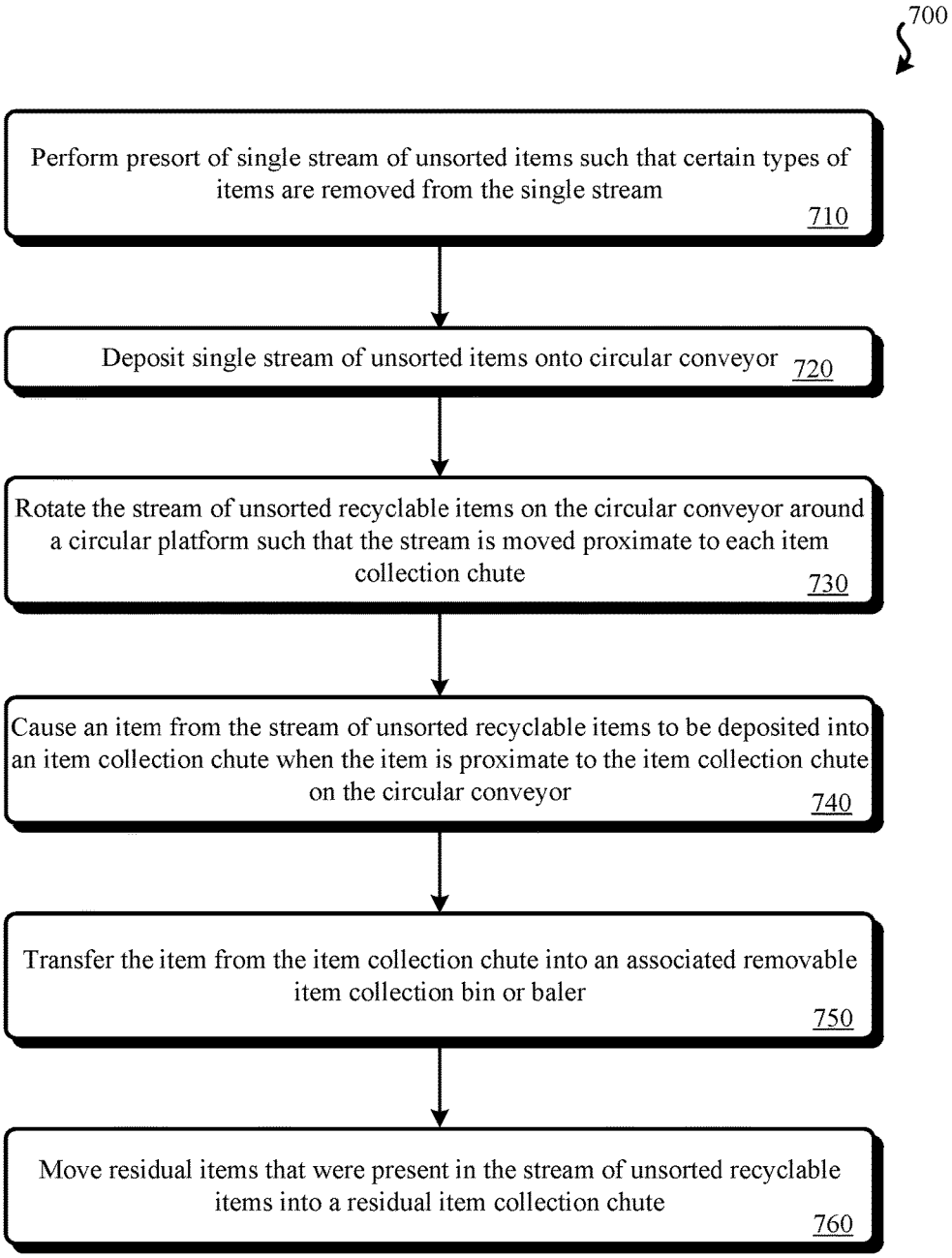
FIG. 7 illustrates another embodiment of a method for using a single-stream sorting system.

FIG. 7 illustrates another embodiment of method 700 for using a single-stream sorting system, such as single-stream sorting system 100 of FIGS. 1-5. At block 710, a presort of a single stream of items that contains recyclable materials may be performed. Automated equipment may be used to remove one or more types of materials from the single-stream. For example, while the single stream is being transmitted to a circular conveyor along an intake conveyor, certain materials may be sorted out based on size and/or density. For common material that is sorted out prior to the being deposited on the circular conveyor is cardboard. In some embodiments, glass may be sorted from the steam before being deposited on the circular conveyor. A magnet-based ferrous metal separator may be used to remove certain types of materials (such as iron-based materials) from the single stream without requiring any action from being performed by an operator prior to deposit onto the circular conveyor.

While the above types of items may be pre-sorted from the single stream of items, it may also be possible for one or more of them to be sorted from the stream using such automated equipment along the circular conveyor. For instance, a magnet-based ferrous metal separator may be present along the circular conveyor. In some embodiments, one or more types of materials may be sorted after the stream of materials has been passed around the circular conveyor. For example, an eddy current separator may be applied to items present in the residual to remove aluminum cans from the residual. Therefore, generally, it should be understood that automated sorting equipment may be used anywhere along the stream of unsorted materials, including on materials classified as residual after having been through the single-stream sorting system.

At block 720, the remaining portion of the single stream may be deposited onto the circular conveyor. The single stream may be deposited onto the circular conveyor at a rate such that items are spread out onto the circular conveyor to a greater degree than on the intake conveyor. This may be accomplished by having the circular conveyor rotating faster than the intake conveyor. In some situations, the opposite situation may be present: the single stream may be deposited onto the circular conveyor at a rate such that items are moved closer together on the circular conveyor than on the intake conveyor. This may be accomplished by having the circular conveyor rotating slower than the intake conveyor. In some embodiments, the rotational speed of the circular conveyor will match the speed of the intake conveyor.

At block 730, the stream of unsorted items that is at least partially made up of unsorted recyclable items is rotated around a (circular) platform such that the single stream is moved proximate to an opening of each item collector chute of the single-stream sorting system. At block 740, as an item moves proximate to an item collector chute that is associated with the recyclable category of the item (type of plastic, cardboard, cans, glass, etc.), an operator may cause the item to leave the circular conveyor and enter the associated item collector chute. This may occur by the user pushing, lifting and depositing, lifting and throwing, or otherwise moving the item into the associated item collector chute. As such, an item in the stream can be expected to only remain on the circular conveyor until it is in the general vicinity of its associated item collector chute.

At block 750, the item may be transmitted from the item collector chute to an associated sorted item collector bin or a baler. Such bins and balers may receive materials deposited into item collector chutes as assisted by gravity or a conveying device.

At block 760, residual items that are present in the stream may be pushed off of the circular conveyor into a residual bin, possibly through a residual item chute. Such residual items may be: unrecyclable materials or materials that an operator was not able to sort before the item arrived at an ejection device. If the residual items are trash, the contents of the associated residual bin may be routed to a landfill. If the residual items were items that had not been sorted yet, the residual item bin may be dumped back onto the intake conveyor or directly onto the circular conveyor to be subject to the sorting process again. In other embodiments, at block 760, when residual items make contact with a stop trigger device, the rotation of the circular conveyor (and intake conveyor) is stopped, thus allowing the one or more operators to catch up with sorting the stream. Once the item that triggered the stop trigger device is removed, the circular conveyor may begin rotating again (and the intake conveyor may begin depositing an unsorted portion of the single stream again).

Figure 8:
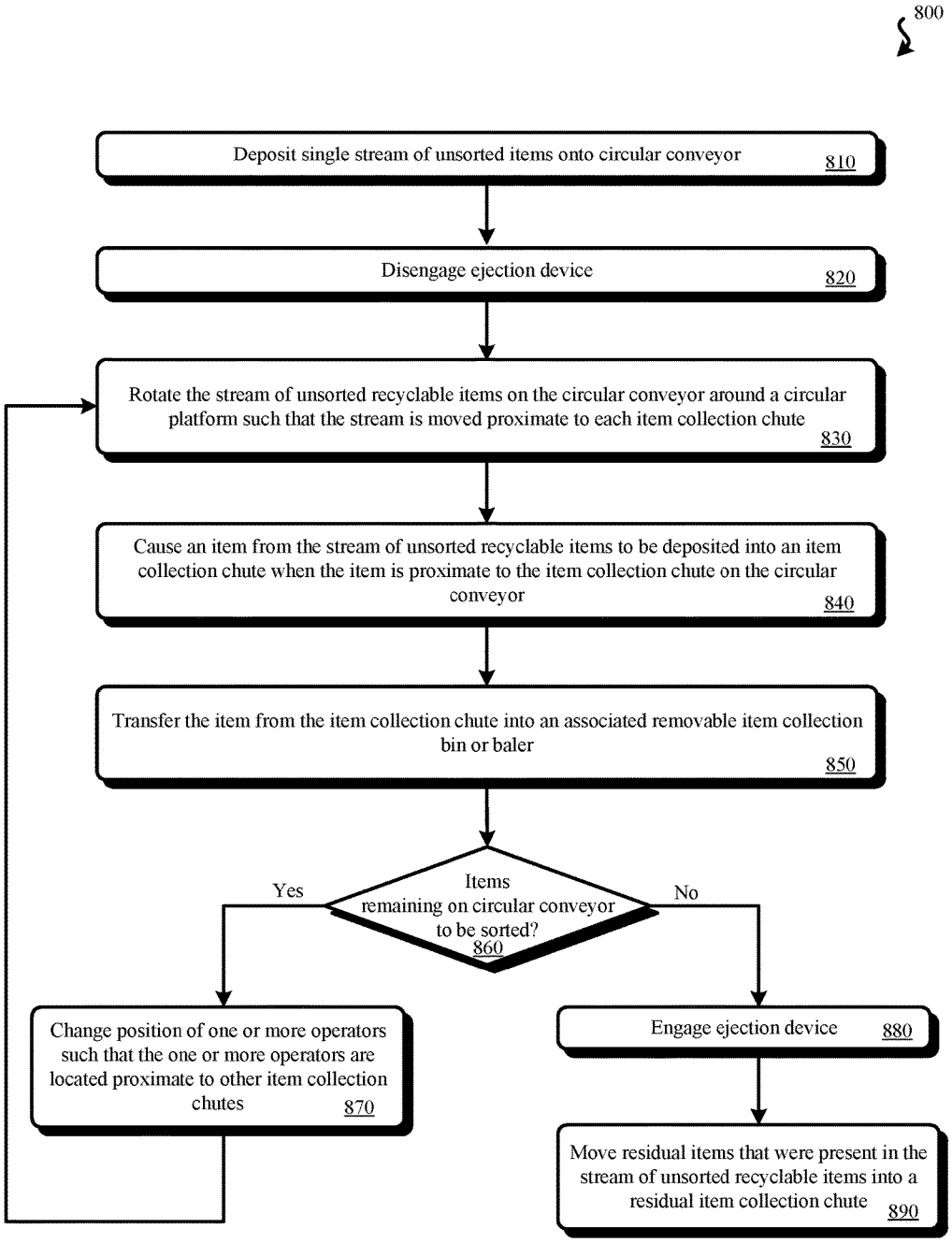
FIG. 8 illustrates an embodiment of a method for using a single-stream sorting system by a small number of operators.

FIG. 8 illustrates an embodiment of a method 800 for using a single-stream sorting system by a small number of operators. Method 800 may employ single-stream sorting system 100 of FIGS. 1-5. Method 800 may allow a small number of operators, such as between 1-4, to operate the single-stream sorting system and sort a stream that includes recyclable items into various categories.

At block 810, similar to block 720, a portion of the single stream may be deposited onto the circular conveyor (this stream may have already been partially sorted, such as according to block 710). Block 810 may involve an intake conveyor depositing unsorted items onto a circular conveyor. At block 810, enough of the single stream of items may be deposited onto the circular conveyor to fill one full revolution of the turning circular conveyor. Once full, the intake conveyor may be stopped. At block 820, an operator may disengage an ejection device. Such disengaging may involve the operator causing the ejection device to be removed from a top surface of the circular conveyor. When disengaged, items on the circular conveyor may revolve around the platform on the circular conveyor until an operator moves such items. Disengaging the ejection device may serve to stop the intake conveyor from depositing unsorted items onto the circular conveyor.

At block 830, the stream of unsorted items that is at least partially made up of unsorted recyclable items is rotated around a platform such that the single stream is moved proximate to an opening of each item collector chute of the single-stream sorting system. At this time, an operator may be positioned in front of one or more of the item collector chutes. At block 840, as an item moves proximate to an item collector chute that is associated with the recyclable category of the item (type of plastic, cardboard, cans, glass, etc.), an operator that is currently attending to such a chute may cause the item to leave the circular conveyor and enter the associated item collector chute. Since a limited number of operators may be available, other chutes may be unattended. Items associated with the categories of such chutes may remain on the circular conveyor and continue rotating around the platform. At block 850, the item deposited in the associated cute may be transmitted from the item collector chute to an associated sorted item collector bin or a baler. Such bins and balers may receive materials deposited into item collector chutes as assisted by gravity.

At block 860, a determination is made, by an operator, whether items present on the circular conveyor remain to be sorted. At least some of such items may correspond to a category of items associated with a chute which was not manned by an operator at an initial run through of steps 830-850. That is, because an operator was attending one or more item collector chutes, other items were skipped from being deposited into the appropriate item collector chute.

At block 860, if the operator determines that items remain present on the circular conveyor that need to be sorted into item collector chutes, method 800 may proceed to block 870. At block 870, the one or more operators may reposition themselves on the platform such that the operators are in position to sort items associated with item collector chutes that have yet to be sorted from the circular conveyor. Following block 870, block 830-860 may repeat until all items that are associated with a sortable item category (other than residual items) have been sorted. Depending on the number of chutes and operators available, the number of times such blocks need to be repeated may vary. During this repetitious process, the circular conveyor may be rotating continuously.

At block 860, if the operator determines that no items remain present on the circular conveyor that need to be sorted into item collector chutes, method 800 may proceed to block 880. At block 880, the ejection device may be re-engaged. When the ejection device is re-engaged, items remaining on the circular conveyor, which may be residual items since they were not sorted into any other item collector chute, may be swept or otherwise removed from the rotating circular conveyor, such as into a residual item chute and associated bin, at block 890. Following step 890, an intake conveyor may be activated and a fresh portion of an unsorted stream of items may be deposited onto the circular conveyor, thus allowing method 800 to be repeated.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered.

What is claimed is:

1. A sorting system for sorting an unsorted stream of items, comprising:

a frame structure;

a platform attached with the frame structure;

a circular conveyor that rotates in either a clockwise or counterclockwise direction to move the unsorted stream of items around the platform, the circular conveyor being attached with the frame structure; and a plurality of item collector chutes arranged in a circular pattern outside of an outer circumference of the circular conveyor, wherein:

the platform is open in nature to allow an operator to move from side to side and from location to location along an inner circumference of the circular conveyor;

each of the plurality of item collector chutes are attached with the frame structure, and the unsorted stream of items deposited on the circular conveyor is rotated around the platform and proximate to each item collector chute of the plurality of item collector chutes to allow items from the unsorted stream of items to be moved from the circular conveyor into the plurality of item collector chutes.

2. The sorting system of claim 1, further comprising a plurality of removable bins, wherein a removable bin of the plurality of removable bins is positioned below some item collector chutes of the plurality of item collector chutes; and an item collector chute of the plurality of item collector chutes is positioned to accommodate a baler being positioned below the item collector chute to receive items directly from the item collector chute.

3. The sorting system of claim 1, wherein the platform is attached with the frame structure such that the platform is raised from ground on which the frame structure stands.

4. The sorting system of claim 1, further comprising:

a stream depositing conveyor that deposits the unsorted stream of items onto a starting position of the circular conveyor, wherein the circular conveyor rotates the unsorted stream of items from the starting position to being proximate to each item collector chute of the plurality of item collector chutes, and then to a final position.

5. The sorting system of claim 4, further comprising: an ejection mechanism, the ejection mechanism being located at the final position to move any portion of the unsorted stream of items remaining on the circular conveyor at the final position into a residual item collector chute.

6. The sorting system of claim 5, wherein the ejection mechanism comprises a brush or blade that sweeps residual items from the unsorted stream of items present on the circular conveyor at the final position into the residual item collector chute.

7. The sorting system of claim 4, wherein at least a portion of the stream depositing conveyor is inclined.

8. The sorting system of claim 1, wherein the platform is circular and the platform has a radius of between 5 feet and 25 feet.

9. The sorting system of claim 1, wherein the plurality of item collector chutes comprises at least seven item collector chutes.

10. The sorting system of claim 1, further comprising an entrance system, wherein the entrance system is attached with the frame structure and allows a user access to the platform under the circular conveyor from the ground on which the frame structure stands.

11. A method for sorting a stream of unsorted recyclable items, the method comprising:

depositing on a circular conveyor the stream of unsorted recyclable items; and moving the stream of unsorted recyclable items on the circular conveyor in a clockwise or counterclockwise direction around a platform such that the stream is moved proximate to each item collector chute of a plurality of item collector chutes to allow items from the stream of unsorted recyclable items to be moved from the circular conveyor into the plurality of item collector chutes, wherein:

the plurality of item collector chutes is arranged in a circular pattern outside of an outer circumference of the circular conveyor; and the platform is open in nature to allow an operator to move from side to side and from location to location along an inner circumference of the circular conveyor on the platform.

12. The method for sorting the stream of unsorted recyclable items of claim 11, further comprising:

causing an item from the stream of unsorted recyclable items to be deposited into an item collector chute when the item is proximate to the item collector chute on the circular conveyor.

13. The method for sorting the stream of unsorted recyclable items of claim 12, further comprising:

transferring, using gravity, the item from the item collector chute into an associated removable sorted item collector bin.

14. The method for sorting the stream of unsorted recyclable items of claim 12, wherein each item collector chute of the plurality of item collector chutes is associated with a type of recyclable.

15. The method for sorting the stream of unsorted recyclable items of claim 11, wherein depositing of the stream of unsorted recyclable items onto the circular conveyor is performed by an inclined stream depositing conveyor onto a starting position.

16. The method for sorting the stream of unsorted recyclable items of claim 15, wherein moving the stream of unsorted recyclable items on the circular conveyor comprises rotating the stream around the platform from the starting position to being proximate to each item collector chute of the plurality of item collector chutes, and then to a final position.

17. The method for sorting the stream of unsorted recyclable items of claim 16, further comprising: moving, by an ejection mechanism, residual items that were present in the stream of unsorted recyclable items into a residual item collector chute.

18. A sorting apparatus, comprising:

a frame means;

a platform means for one or more operators, the platform means being attached with the frame means;

a conveyor means that rotates in either a clockwise or counterclockwise direction to move a stream of unsorted stream items around the platform means, the conveyor means being attached with the frame means; and a plurality of item collection means arranged in a circular pattern outside of an outer circumference of the conveyor means, wherein:

the platform means is open in nature to allow an operator to move from side to side and from location to location along an inner circumference of the conveyor means; and the plurality of item collection means are each attached with the frame means, and the stream of unsorted stream items deposited on the conveyor means is rotated around the platform means and proximate to each item collection means of the plurality of item collection means to allow items from the stream of unsorted stream items to be moved from the conveyor means into the plurality of item collection means.

19. The sorting apparatus of claim 18, further comprising a depositing means that deposits the stream onto a starting position of the conveyor means, wherein the conveyor means rotates the stream from the starting position to being proximate to each item collector chute of the plurality of item collection means, and then to a final position.

20. The sorting apparatus of claim 19, further comprising an ejection means that moves residual items from the stream present on the conveyor means at the final position into a residual item collection means.

* * * * *